United States Patent [19]

Polise et al.

[11] 4,384,435

[45] May 24, 1983

[54] INFLATABLE TENT

[76] Inventors: Victor W. Polise, 808 Washington Ave., Woodbine, N.J. 08270; Robert Marinacci, 112 Pacific Ave., Minitola, N.J. 08341

[21] Appl. No.: 281,515

[22] Filed: Jul. 8, 1981

[51] Int. Cl.[3] ..... E04B 1/345

[52] U.S. Cl. ..... 52/2

[58] Field of Search ..... 52/2

[56] References Cited

U.S. PATENT DOCUMENTS

| | | | |
|---|---|---|---|
| 3,332,177 | 7/1967 | Sepp | 52/2 |
| 3,742,657 | 7/1973 | Price | 52/2 |
| 3,909,992 | 10/1975 | Stachiw | 52/2 |
| 3,924,363 | 12/1975 | Candle | 52/2 |
| 4,000,749 | 1/1977 | Busco | 52/2 |
| 4,068,418 | 1/1978 | Masse | 52/2 |
| 4,103,369 | 8/1978 | Riordan | 52/2 |

FOREIGN PATENT DOCUMENTS

| | | | |
|---|---|---|---|
| 48-373191 | 11/1973 | Japan | 52/2 |

*Primary Examiner*—J. Karl Bell

*Attorney, Agent, or Firm*—Thomas A. Lennox

[57] ABSTRACT

A hemispherical inflatable tent of a plurality of compartments generally in the shape of orange sections, inflated through a manifold in the top of the tent communicating with each compartment section.

16 Claims, 11 Drawing Figures

INFLATABLE TENT

BACKGROUND OF THE INVENTION

1. Field of the Invention

Present invention relates to inflatable tent structures, generally constructed of flexible sheet material suitable for camping and other temporary type structures.

2. Description of the prior art

There has for some time been an increasing interest in outdoor living and particularly in temporary structures, such as tents for use in camping outdoors. Tents are typically constructed of waterproofed cloth, typically fibrous reinforced plastic film, to form an enclosure held up by a variety of posts and support configurations, both inside and outside of the enclosure. Problems associated with these posts and support members are well known to those persons camping out. A great deal of failures occur due to breakage, deterioration and misuse, causing substantial delay in setting up camp, or even complete failure of the device, at a particularly inappropriate time. To avoid these problems, possible solutions have included trailers which include tent like structures, which raise from the bed. The same mechanical difficulties ultimately prevail in this type of structure as with the standard tent structures.

A number of inflatable structures have been provided utilizing an air blower which creates continuous air pressure within the structure with controlled escape of air provided somewhere within the structure. Typical of these structures are described in the U.S. Pat. No. 3,909,992 to J. D. Stachiw, U.S. Pat. No. 3,924,363 to R. D. Candle and U.S. Pat. No. 4,103,369 to D. B. Riordan. Also utilizing air pressure as well as separate inflatable compartments is the isolation module described in U.S. Pat. No. 4,000,749 to F. J. Busco. An additional inflatable enclosure is described in U.S. Pat. No. 3,999,333 to J. G. Amarantos utilizing an endless hollow header anchored to the floor or the ground.

None of the prior art described above fills the needs of the outdoor camper and does not satisfy the objects of this invention listed hereinbelow.

SUMMARY OF THE INVENTION

The present invention satisfies the need of the outdoor camper as described hereinabove.

An object of this invention is to provide an inflatable tent that does not require continuous air supply and after inflation will retain its structural integrity, despite loss of power.

It is a further object of this invention to provide a inflatable tent structure that provdes an insulation from the outdoor elements.

It is a further object of this invention to provide an inflatable tent that requires no permanent attachment to a floor or the ground and may be moved from place to place as the camper desires.

It is an additional object of this invention to provide an inflatable tent which may be easily inflated with either one or only a few attachments to a compressed air source.

It is an additional object of this invention to provide a stable structure wherein a puncture will not cause deflation of the entire structure.

It is a further object of this invention to provide a structure that includes window and door configuration units without significantly affecting the structural characteristics of the tent.

It is an additional object of this invention to provide a structure that uses no support poles and no continuous air source.

The inflatable tent of this invention is generally in the shape of a hemisphere with the edge resting on the ground. It should be understood that by the term "hemisphere" it is understood that this term as used here and in the claims includes only the general shape of the tent and is intended to include those shapes having a greater amount than one-half of the spherical surface, and in some cases less than the total surface of a hemisphere. It is preferred that the shape actually include a surface greater than the hemisphere as pictures in the preferred embodiments, and it is more preferred that the shape be one-half up to three-quarters of the sphere. The shape is determined by a plane passing perpendicular to the central axis of the sphere, cutting through the outer surface and preferably using the larger of the two parts remaining. The tent includes a plurality of compartments, each having an outer face and an inner face, with the outer faces of the compartments combining to form the outer surface of the hemispherical shape. There are a sufficient number of compartments such that the combination of the outer faces forms the outside surface of the hemispherical shape. The outer and inner face shapes each have two generally vertical side edges, each edge being defined by the intersection of a plane passing through and extending from the vertical axis of the sphere and extending through the outer surface of the hemisphere. Each compartment may be considered to generally take the shape of a section, not unlike that of an orange, except that an inner cavity in the hemispherical shape is provided. A bottom sealing mechanism is provided so that the lower edges of the outer and inner faces of each compartment are sealed together, and preferably includes a lower bottom wall sealed to the inner and outer faces. A marginal sealing device seals the side edges of the outer and inner faces of each compartment and further seals these marginal edges to the marginal edges of the next adjacent section compartment to form the hemispherical shape. It is preferred that this marginal sealing mechanism include a side wall which extends along the marginal edge to define the thickness of the compartment and thus the wall structure. It is preferred that the number of compartments be six to twenty in number and more preferred that they be ten to fourteen in number. An opening is provided in each compartment near the top, close to the vertical central axis. A manifold including an air input aperture capable of connection to a pressurized air source, such as an air pump, a chamber in air flow communication with a plurality of passage openings in the chamber, one for each compartment, wherein each passage is directed radially from the central axis. A sealing mechanism is provided connecting each passage to the opening of the complimentary compartments. It is preferred that the manifold include a valve device for each compartment and a by-pass device for deflation of the entire structure.

It is preferred that at least one compartment have a transparent window section placed in the outer and inner faces, wherein the periphery edges of the window section in the outer and inner faces are sealably attached to form a portion of the compartment.

DESCRIPTION OF PREFERRED EMBODIMENTS

Figure 1:
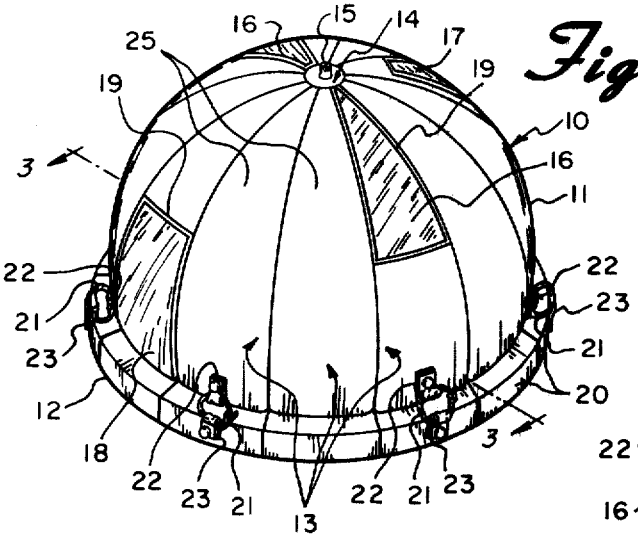
FIG. 1 is a perspective view of the inflatable tent of this invention.
Figure 2:
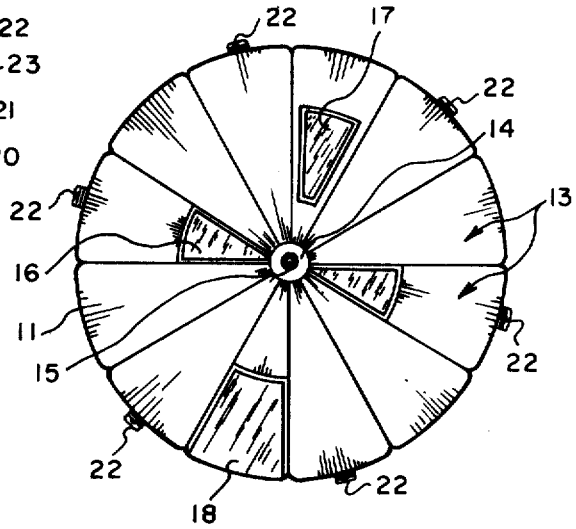
FIG. 2 is a top view looking down on the tent structure.
Figure 3:
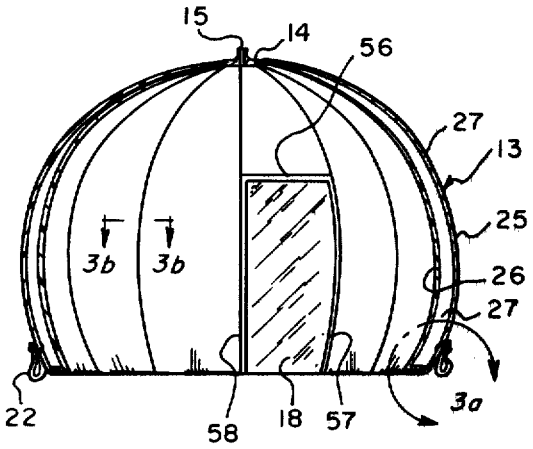
FIG. 3 is a cross-sectional view taken along lines 3—3 of FIG. 1.
Figure 3A:
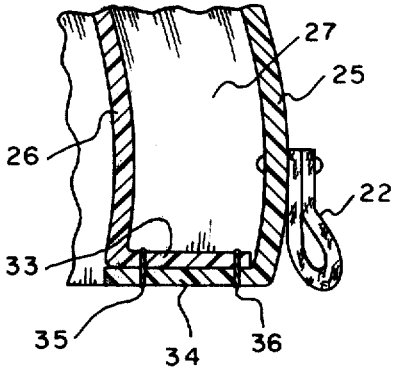
FIG. 3A is a close up cross-sectional view of the bottom of a section illustrating the bottom wall construction from FIG. 3.
Figure 3B:
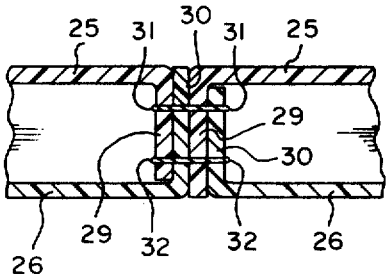
FIG. 3B is a cross-sectional view taken along lines 3A—3A of FIG. 3 to illustrate the wall joint construction between sections.

In FIG. 1, tent 10 is illustrated in perspective view, including tent enclosure 11 and floor 12. Enclosure 11 is constructed of twelve separate compartment sections 13, each being a section of the generally hemispherical shape of enclosure 11. Outside faces 25 of sections 13 are all that is visible in FIG. 1. An essentially identical shaped inside face 26 (hidden in FIG. 1) forms the main body of each section 13. Each section 13 is constructed of 5 to 20 mil nylon cloth reinforced, plasticized polyvinyl chloride polymer film which provides an air-tight shield. Each section 13 is inflated by manifold 14 through air valve input 15. As illustrated, enclosure 11 is equipped with sealed transparent skylights 16, window 17 and door 18, each constructed to form an inflatable portion of the respective section 13, which utilizes the air pressure in its respective section 13 to maintain support of the section. Skylights 16 utilize a clear, plasticized, unreinforced, polyvinyl chloride polymer film sealed into frame 19 of the regular reinforced film. Floor 12 is constructed of sections 20, each being a pie shaped section of the floor. Tent enclosure 11 and floor 12 are fixed together through tie ropes 21 between loop lug 22 on section 13 and loop lug 23 on section 20. In FIG. 2, enclosure 11 is shown in the top view and in FIG. 3, a cross-sectional view along lines 3—3 of FIG. 1 is illustrated. In this latter view, outside face 25 is shown with inside face 26 to form a section 13 with air space 32, sealably enclosed to form each section 13. In FIG. 3A, a close up of the bottom wall of section 13 is illustrated, showing inside face 26 folded under and outwardly to form inner flap 33 and outside face 25 being folded inwardly to form outer flap 34, which when sealed with PVC adhesive and sewn at inner seal 35 and outer seal 36 forms the lower wall of each section 13. In FIG. 3B, a cross-sectional view is taken from above to illustrate the joining of each section and construction of the joint wall between each section. Each outside face 25 is folded inwardly to form outside flap 29 and each inside face 26 is folded outwardly to form inside 30. PVC adhesive is used to seal the four layers together and the joint wall is further held together with outside nylon sewn seal 31 and inside sewn seal 32.

Figure 4:
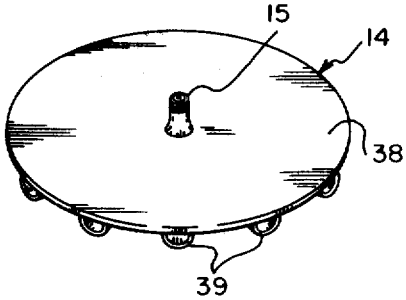
FIG. 4 is a perspective view looking from the top of the manifold located in the top of the tent structure.
Figure 5:
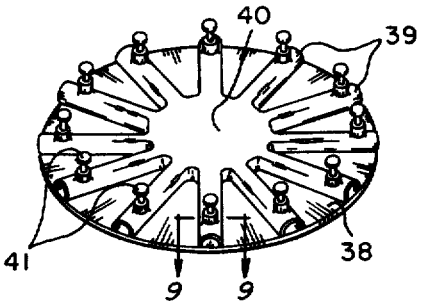
FIG. 5 is a perspective view looking from the bottom of the manifold pictured in FIG. 4.
Figure 8:
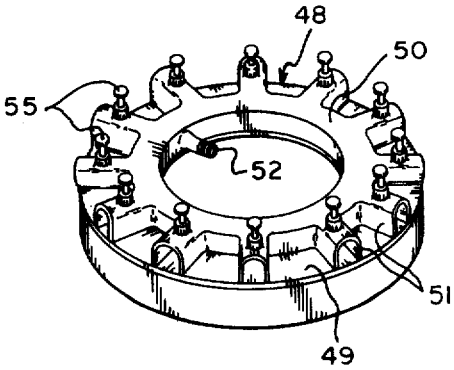
FIG. 8 is a perspective view of the manifold used in the center of the floor pictured in FIG. 6.
Figure 9:
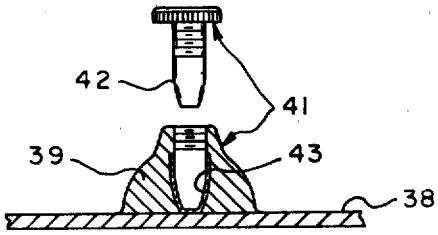
FIG. 9 is an exploded cross-sectional view taken along lines 9—9 of FIG. 5 to illustrate the valve construction.

Manifold 14 is illustrated in FIG. 4 showing standard air pressure valve input 15 threaded on the outside to receive a standard air pressure connector from an air pump, capable of providing pressure up to about 10 to 30 psig. Manifold 14 is constructed of ⅛ inch thick rigid thermoset plastic for all parts including top wall 38. One inch OD passage spoke tubes 39 are sealably attached to top 38 to extend radially in air flow communication from central housing 40 as illustrated in the bottom view of FIG. 5, which is in direct air communication with air input 15. Each tube 39 is connected to its respective section 13 through a tube and seal system as shown below in FIG. 8. Each passage tube to 39 is equipped with valve 41, capable of completely closing off the tube. The cross-sectional view of FIG. 9 taken along lines 9—9 of FIG. 5 illustrates the molded valve 41 with threaded handle and seat stem 42 which interfits with seat 43 to seal off and close passage 39. Enclosure 11 is inflated by attachment of an air source to air input 15. When enclosure 11 has been completely inflated, the air source is turned off and the enclosure entered to close off each of valves 41. Puncture of a single section 13 will not significantly affect the structural integrity of enclosure 11. Actually, the puncture may be sealed in place and by re-opening valve 41 for that particular section 13, it may be inflated with a suitable air pump.

Figure 6:
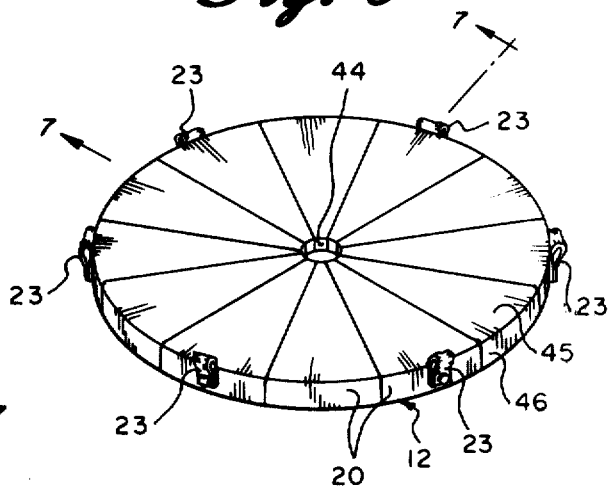
FIG. 6 is a perspective view of the inflatable floor of the tent structure.
Figure 7:
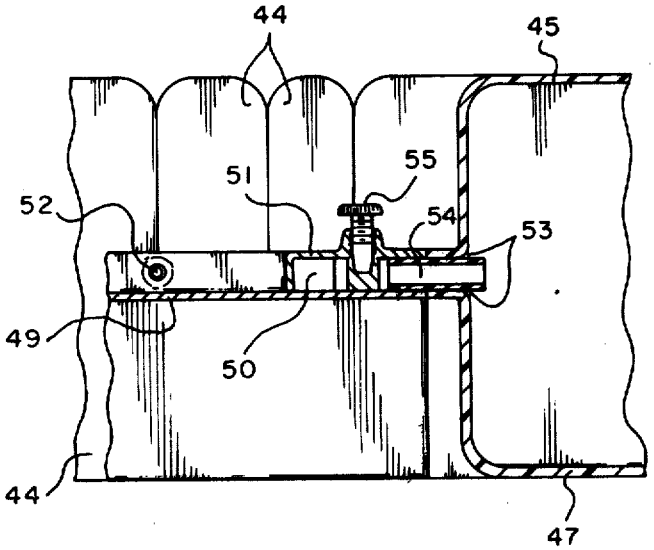
FIG. 7 is a partial cross-sectional view of the floor and manifold taken along line 7—7 of FIG. 6.

In FIG. 6, floor 12 is illustrated as constructed of sections 20 which are inflated fibrous reinforced plastic of the same material as enclosure 11. As with enclosure 11, all joints are over lapped, double stitched and sealed to be air tight, as illustrated in FIG. 3B. Each section 20 is constructed of top 45, outside sidewalls 46 (constructed as shown in FIG. 3A) and bottom 47 which is identical in shape to top 45. In the center of floor 12 is located manifold 48, as pictured in FIG. 8, constructed of thermoset plastic including bottom plage 49, on which is welded ring enclosure 50 with passage tubes 51 radiating out and in air communication with ring housing 50. Each tube 51 is equipped with shut-off valves 55 identical to that of FIG. 9. Each tube 51 is connected to sections 20, as illustrated in the cross-sectional view of FIG. 7. Aperture 53 is formed in central wall 44 of section 20. One end of plastic tube 54 is adhesively sealed in aperture 53 and the other end is adhesively sealed in tube 54 to provide direct air communication to ring housing 50. Door 18 is constructed such that upper edge 56 and leading vertical edge 57 are not attached to the adjacent section 13. Hinge edge 58 is constructed as illustrated in FIG. 3B, except that inside sewn seal 32 is skipped so that door 18 may swing free on outside sewn seal 31. Air is introduced to inflate floor 12 through air valve input connector 52. Central wall 44 provides a seal between top 45 and bottom 47 constructed as shown in FIG. 3A.

The transparent portions of the enclosure such as the windows, skylight and door are illustrated as merely portions of the inner and outer faces. They may be constructed independently with or without a frame inflated and constructed of the reinforced materials of the respective faces. It is preferred that the enclosure be constructed of six to twenty separate air-tight compartment sections and more preferably constructed of ten to fourteen such sections. The edge sealing means sealing all the edges of the faces, including the generally vertical side edges, they being defined by the intersection of the plane passing from the central axis of the hemisphere through the surface of the hemispherical shape, as well as the bottom edges resting on the ground provide an interconnection and seal between the faces as well as the faces of the adjacent sections and further define the thickness of the compartment of each thickness and thus the wall thickness of the enclosure. The preferred inner face edge sealing device is an interleafing of the face edges with an adhesive bonding agent between each face and a sewn stitch through all layers interleafed together. It is more preferred that there be a sewn stitch close to the plane of the outer face of the section as well as a second sewn stitch along the plane of the inner faces. Thus, the construction of the inner face edge of the generally vertical edges is an interleafing of four layers of material with two rows of stitching, one close to the adjacent outer faces of the adjacent sections and one close to the inner faces of adjacent sections. The distance between these two stitch lines defines the thickness of the wall of the enclosure. The manifold includes an air input aperture, preferably a pressure actuated valve closure, similar to that on automobile tires, a chamber in air flow communication with the air input, the shape of the chamber preferably being in the shape of a round wafer with the air input on the top wall of the wafer. A plurality of passageway openings, equal in number to the number of sections of the enclosure, are provided with air-tight closure mechanisms such a valve to open and close each passageway opening independantly. Each opening is directed radially to each section of the enclosure. An inflatable floor is preferably included generally in the shape of an annular ring of pie-sections, each section being a sealed compartment with a top face and a bottom face. Inner face edge sealing means seal the edges of the top face to the bottom face as they meet to form the air-tight compartments, join adjacent pie-sections to form the floor and define thickness of the floor. A manifold is located in the center cavity of the floor, preferably of an annular shape including an annular chamber and air input apperture, a plurality of passageway openings radiating outwardly from the chamber, one for each pie-section, and a closure means for each passageway opening, capable of opening and closing air flow in and out of each opening. An opening is provided in each pie-section near the center of the section opening into the center cavity and each passageway opening is sealably connected to the opening in each pie-section. Each pie-section and inner face edge sealing system comprise an outside circle vertical wall, vertical side walls radiating from the center of the annular shape joining adjacent pie-sections, and an inner section wall defining the center cavity. Again, inner face edge sealing means for the floor includes material of the faces interleafed together, and adhesive seal between inner faces and at least one sewn stitch along the length of the inner face through all thicknesses being joined.

While this invention has been described with reference to the specific embodiments disclosed herein, it is not confined to the details set forth and the patent is intended to include modifications and changes which may come within and extend from the following claims.

We claim:

1. An inflatable enclosure, generally in the shape of a hemisphere, comprising a plurality of sections, each being an air-tight compartment and each having an outer face and an inner face, wherein the number of compartments is sufficient in number such that the outer faces, when joined, form the outer hemispherical shape, wherein the outer face of each section has two generally vertical side edges, the edges being defined by the intersection of plane extending from the vertical central axis of the sphere with the spherical surface, a bottom sealing means to seal lower edges of the inner and outer faces together, a marginal sealing means to seal the vertical edges of the inner and outer faces of each section to each other and to seal these edges to the vertical edge of the next adjacent section to form the hemispherical shape, an opening in each section near the top of the section, close to the vertical central axis of the hemisphere, a manifold comprising an air input aperture, a chamber in air flow communication with the aperture and a plurality of passageway openings, one opening for each section, each opening directed radially from the central axis of the sphere, and sealing means to sealably connect each passageway in air communication to the opening in each section.

2. The enclosure of claim 1 wherein at least one section comprises a transparent window portion in both the inner and outer faces of the compartment, wherein the periphery edges of the inner and outer faces of the window portion are sealably attached to form an inflatable window shape in the section.

3. The enclosure of claim 2 wherein the window aperture is covered with a clear plastic material.

4. The enclosure of claim 1 wherein the material of the inner and outer faces is fibrous reinforced plasticized polymer film.

5. The enclosure of claim 4 wherein the polymer film is plasticized polyvinyl chloride.

6. The enclosure of claim 1 wherein there are six to twenty sections.

7. The enclosure of claim 6 wherein there are ten to fourteen sections.

8. The enclosure of claim 1 wherein the bottom sealing means comprises a bottom wall sealed to the outer face and the inner face and at the exposed ends to the adjacent compartment edges.

9. The enclosure of claim 1 wherein the outer hemispherical shape comprises at least one-half of a sphere and is less than three-quarters the surface of a sphere.

10. The inflatable enclosure of claim 1 wherein a closure means is included in the manifold to allow air tight closure of each passageway independent of the chamber.

11. The inflatable enclosure of claim 1 wherein the sealing means is a tube sealably attached to the passageway, inserted into the opening of the section and sealably attached to the opening.

12. The inflatable enclosure of claim 1 wherein an annular floor is provided detachably attached to the inflatable enclosure comprising a ring of pie-sections, each section being a sealed compartment with a top face and a bottom face, an interface edge sealing means sealing edges of the top face to the bottom face as they meet to form the air-tight compartment, joining adjacent pie-sections to form the floor, and defining the thickness of the floor, an annular manifold located in the center cavity comprising an annular chamber, an air input aperture, a plurality of passageway openings radiating outwardly from the chamber, one for each pie-section, and a closure means for each passageway opening, capable of opening and closing air flow in and out of each passageway, an opening in each pie-section near the center of the section, and sealing means to sealably connect each passageway in air communication to the opening in each pie-section.

13. The enclosure of claim 12 wherein each pie-section and the interface edge sealing means comprise an outside circle vertical wall, vertical side walls radiating from the center of the annular shape joining adjacent pie-sections, and an inner vertical wall defining the center cavity, wherein the interface edge sealing means comprises the material of the faces interleaved together, an adhesive seal between the interfaces and at least one sewn stitch along the length of the interface through all thicknesses being joined.

14. An inflatable enclosure, generally in the shape of a hemisphere, comprising a plurality of sections, each section being an air-tight compartment and each having an outer face and an inner face, wherein the number of compartments is sufficient in number such that the outer faces, when joined together, form the outer hemispherical shape, wherein the outer face of each section has two generally vertical side edges, the edges being defined by the intersection of a plane extending from the vertical central axis of the hemisphere with the hemispherical surface, interface edge sealing means sealing the edges of the faces meeting to form each air-tight compartment section, sealing opposed vertical side edges of adjacent sections to form the hemispherical shape, and defining the thickness of the compartment of the sections and the wall of the enclosure, an opening in each section near the top of the compartment close to the vertical central axis of the hemisphere, a manifold comprising an air input aperture, a chamber in air-flow communication with the aperture and a plurality of passageway openings, one opening for each section, and an air-tight closure means to open and close each passageway opening with each opening directed radially from the central axis of the hemisphere, and sealing means to sealably connect each passageway in air communication to the opening in each section.

15. An inflatable enclosure, generally in the shape of a hemisphere, comprising a plurality of sections, each being an air-tight compartment and each having an outer face and an inner face, wherein the number of compartments is sufficient in number such that the outer faces, when joined, form the outer hemispherical shape wherein the outer face of each section has two generally vertical side edges, the edges being defined by the intersection of plane extending from the vertical central axis of the sphere with the spherical surface, a bottom sealing means to seal lower edges of the inner and outer faces together, a marginal sealing means to seal the vertical edges of the inner and outer faces of each section to each other and to seal these edges to the vertical edge of the next adjacent section to form the hemispherical shape, an opening in each section near the top of the section, close to the vertical central axis of the hemisphere, a manifold comprising an air input aperture, a chamber in air flow communication with the aperture and a plurality of passageway openings, one opening for each section, each opening directed radially from the central axis of the sphere, sealing means to sealably connect each passageway in air communication to the opening in each section.

an annualr floor detachably attached to the inflatable enclosure comprising a ring of pie-sections, each section being a sealed compartment with a top face and a bottom face, an interface edge sealing means sealing the edges of the top face to the bottom face as they meet to form the air-tight compartment, joining adjacent pie-sections to form the floor and defining the thickness of the floor, an annular manifold located in the center cavity comprising an annular chamber, an air input aperture, a plurality of passageway openings radiating outwardly for each pie-section and a closure means for each passageway opening, capable of opening and closing air flow in and out of the manifold, an opening in each pie-section near the center of the section, and sealing means to sealably connect each passageway in air communication to the opening in each pie-section.

16. An inflatable enclosure, generally in the shape of a hemisphere, comprising a plurality of sections, each section being an air-tight compartment and each having an outer face and an inner face, wherein the number of compartments is sufficient in number such that the outer faces, when joined together, form the outer hemispherical shape, wherein the outer face of each section has two generally vertical side edges, the edges being defined by the intersection of a plane extending from the vertical central axis of the hemisphere with the hemispherical surface, interface edge sealing means sealing the edges of the faces meeting to form each air-tight compartment section, sealing opposed vertical side edges of adjacent sections to form the hemispherical shape, and defining the thickness of the compartment of the sections and the wall of the enclosure, an opening in each section near the top of the compartment close to the vertical central axis of the hemisphere, a manifold comprising an air input aperture, a chamber in air-flow communication with the aperture and a plurality of passageway openings, one opening for each section, and an air-tight closure means to open and close each passageway independently, with each opening directed radially from the central axis of the hemisphere, sealing means to sealably connect each passageway in air communication to the opening in each section, an annular floor detachably attached to the inflatable enclosure comprising a ring of pie-sections, each section being a sealed compartment with a top face and a bottom face, and interface edge sealing means sealing the edges of the top face to the bottom face as they meet to form the air-tight compartment, joining adjacent pie-sections to form the floor, and defining the thickness of the floor, an annular mainfold located in the center cavity comprising an annular chamber, an air input aperture, a plurality of passageway openings radiating outwardly from the chamber, one for each pie-section, and a closure means for each passageway opening, capable of opening and closing air flow in and out of each pie-section, an opening in each pie-section near the center of the section, and sealing means to sealably connect each passageway in air communication to the opening in each pie-section.

* * * * *